United States Patent [19]

Stenmans

[11] Patent Number: 4,736,579

[45] Date of Patent: Apr. 12, 1988

[54] VARIABLE LENGTH BOBBIN HOLDER FOR A TEXTILE MACHINE

[75] Inventor: Heinz Stenmans, Grefrath, Fed. Rep. of Germany

[73] Assignee: Palitex Project Company GmbH, Krefeld, Fed. Rep. of Germany

[21] Appl. No.: 917,849

[22] Filed: Oct. 14, 1986

[30] Foreign Application Priority Data

Oct. 19, 1985 [DE] Fed. Rep. of Germany ..... 3537338

[51] Int. Cl.[4] ..... D01H 7/86; B65H 49/14; B65H 75/24

[52] U.S. Cl. ..... 57/58.52; 57/58.49; 57/58.83; 57/90; 57/129; 242/118; 242/118.3; 242/118.41; 242/118.6

[58] Field of Search ..... 57/129–135, 57/58.49, 58.52, 58.83, 90; 242/118, 118.1, 118.11, 118.2, 118.3, 118.31, 118.32, 118.41, 118.6, 118.61, 129, 128

[56] References Cited

U.S. PATENT DOCUMENTS

| | | | |
|---|---|---|---|
| 1,995,533 | 3/1935 | Bochmann et al. | 57/58.52 |
| 2,924,396 | 2/1960 | Phillips | 242/118.32 X |
| 2,936,964 | 5/1960 | Tigges | 242/118.1 |
| 3,119,224 | 1/1964 | Kocks | 57/58.52 |
| 3,122,877 | 3/1964 | Keyser | 57/129 |
| 3,415,049 | 12/1968 | Nimtz | 57/58.49 |
| 3,433,432 | 3/1969 | Willis | 242/118.1 |
| 3,552,693 | 1/1971 | Scherf | 57/58.52 X |
| 3,717,989 | 2/1973 | Heimann et al. | 57/58.52 |
| 3,740,976 | 6/1973 | Fyans | 242/118.1 X |
| 3,759,460 | 9/1973 | Fyans | 242/118.1 |
| 3,902,679 | 9/1975 | Bost | 242/129 |
| 4,067,180 | 1/1978 | Bleeck | 57/58.52 |
| 4,542,618 | 9/1985 | Lossa | 57/58.83 |

*Primary Examiner*—John Petrakes

*Attorney, Agent, or Firm*—Bell, Seltzer, Park & Gibson

[57] ABSTRACT

A bobbin holder is provided for holding one or more bobbins of thread of varying heights in superimposed positions and adapted for being loosely and removably inserted into a bobbin carrier of a textile machine. The bobbin holder includes an elongate tubular body for receiving one or more hollow bobbins of thread on the outside thereof along the axial length thereof, mechanisms for varying the length of the elongate body for accommodating bobbins of varying heights, and a radially-outwardly-projecting support carried on the lower end of the tubular body for supporting the bobbin or bobbins of thread on the tubular body. The elongate body preferably comprises at least two tubular portions connected together at respective ends thereof by the length varying mechanisms.

16 Claims, 3 Drawing Sheets

VARIABLE LENGTH BOBBIN HOLDER FOR A TEXTILE MACHINE

FIELD OF THE INVENTION

This invention relates to a variable length bobbin holder for holding one or more bobbins of thread of varying height in superimposed positions and adapted for being loosely and removably inserted into a bobbin carrier of a textile machine, preferably a two-for-one twister textile thread processing machine.

BACKGROUND OF THE INVENTION

Bobbin holders heretofore utilized in textile machines, particularly two-for-one twister textile yarn processing machines, for holding one or more bobbins of thread of varying heights in superimposed positions for being loosely and removably inserted into a bobbin carrier of the textile machine were constructed utilizing a tubular body for receiving the bobbins on the outside thereof and incorporated a support member on the lower end thereof which projected radially-outwardly for supporting the bobbins on the tubular body. However, the tubular bodies of these previously used bobbin holders were of predetermined length and could not accommodate one or more bobbins of varying heights, but had to be specifically constructed for particular height bobbins. An example of such previously utilized bobbin holders may be seen in German Patent No. 15 60 257 which corresponds to U.S. Pat. No. 3,415,049.

OBJECT AND SUMMARY OF THE INVENTION

Accordingly, it is the object of this invention to provide a bobbin holder, of the type discussed above, which overcomes the problem discussed above with respect to use thereof in holding one or more bobbins of varying heights in superimposed positions.

By this invention, it has been found that the above object may be accomplished by providing a bobbin holder for holding one or more bobbins of varying heights in superimposed positions and adapted for being loosely and removably inserted into a bobbin carrier of a textile machine, wherein the bobbin holder includes the following. An elongate tubular body is provided for receiving one or more hollow bobbins of thread on the outside thereof along the axial length thereof. Means are provided for varying the length of the tubular body for accommodating bobbins of varying heights. A radially-outwardly projecting support is carried on the lower end of the tubular body for supporting the bobbin or bobbins of thread on the tubular body. Preferably, the elongate body comprises at least two tubular portions connected together at respective ends thereof by said length varying means.

In a first preferred form of bobbin holder in accordance with this invention, the tubular portions of the elongate body include thread means thereon and the length varying means comprises an elongate sleeve member having cooperating thread means thereon for receiving the thread means of the tubular portions of the elongate body. It is also preferred to have the thread means on the tubular portions of the elongate body as internal threads and the thread means on the sleeve member as external threads so that the sleeve member may be positioned inside the tubular portions of the elongate body. The tubular portions of the elongate body may preferably have corrugated walls defining shallow round threads on the inside and outside surfaces thereof and such tubular portions of the elongate body may be extruded plastic members.

In a second preferred embodiment of bobbin holder in accordance with this invention, the elongate body comprises movable telescoping portions and the means for varying the length of the elongate body comprises cooperating means on the telescoping portions for locking the telescoping portions in a plurality of telescoping positions. Such locking means may comprise a plurality of axially spaced apertures along one of the telescoping portions and a resilient detent member on the other of the telescoping portions for being received in a selected one of the apertures.

Either preferred embodiment of such bobbin holder may include at least one bobbin centering ring on the outside of the elongate body and means for adjustably positioning the bobbin centering ring at desired axial positions along the elongate body.

The bobbin holder of this invention may preferably be used in a two-for-one twister textile thread processing machine which includes a spindle assembly for processing thread received from the bobbin or bobbins held by the bobbin holder and which includes a bobbin carrier mechanism for loosely and removably receiving the bobbin holder. The spindle assembly includes a hollow thread entry tube for being positioned within the bobbin holder and for receiving thread from the bobbins for processing in the spindle assembly. Preferably, the bobbin holder includes a hollow head piece removably secured within the upper part of the elongate body for cooperating with the thread entry tube of the spindle assembly to provide an entry passageway for the thread from the bobbin or bobbins carried by the bobbin holder into the spindle assembly.

This head piece preferably comprises a stationary tubular member extending downwardly from the top of the bobbin holder, a movable tubular member telescopingly positioned on the lower portion of the stationary member and having a generally downwardly-diverging funnel-shaped lower end portion for being positioned over the top of the thread entry tube of the spindle assembly, and spring means operatively associated with the stationary member and the movable member for biasing the movable member downwardly while allowing upward movement of the movable member against the bias for positioning the funnel-shaped end portion over the top of the thread entry tube of the spindle assembly. The bobbin holder may further include a thread insert tube having a lower end portion removably positioned within the upper part of the head piece for providing an additional thread entry passageway and a manually graspable handle for the bobbin holder. A detent mechanism may be provided for removably securing the thread insert tube in the head piece of the bobbin holder.

BRIEF DESCRIPTION OF THE DRAWINGS

While some of the objects and advantages of this invention have been set forth above, other objects and advantages will appear as the description proceeds in conjunction with the attached drawings, in which.

DETAILED DESCRIPTION OF PREFERRED EMBODIMENTS

Figure 1:
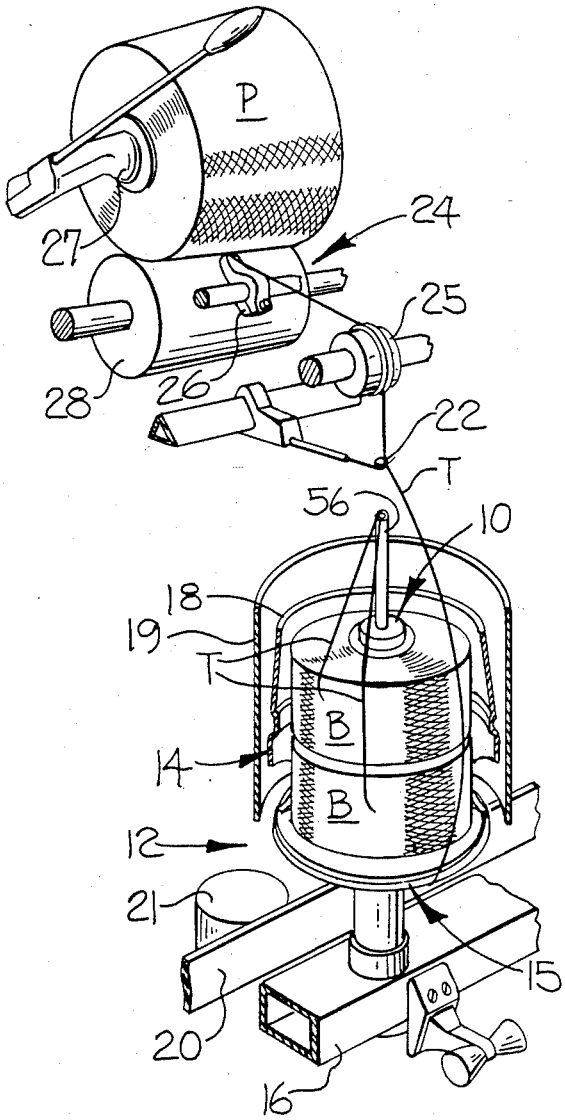
FIG. 1 is a schematic perspective view, partially broken away, illustrating one thread processing station of a two-for-one twister textile thread processing machine utilizing the bobbin holder of this invention.
Figure 2:
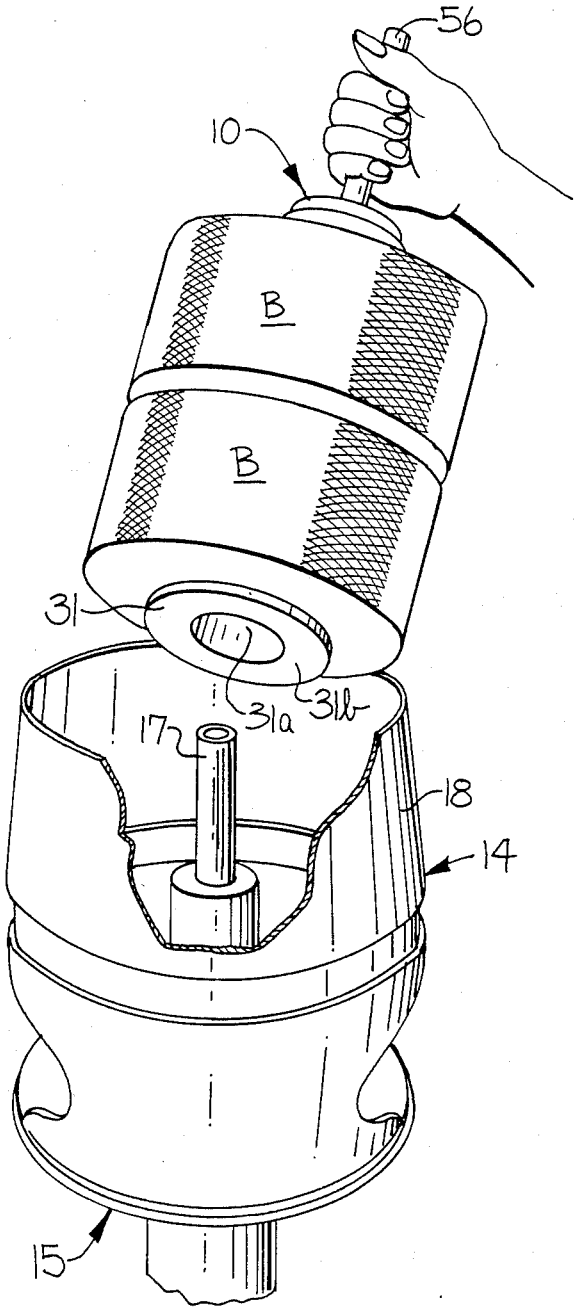
FIG. 2 is an enlarged perspective view of the bobbin carrier of the spindle assembly shown in FIG. 1 with the bobbin holder of this invention being manually held for insertion into the bobbin carrier.

Referring now to the drawings, FIGS. 1 and 2 illustrate the bobbin holder 10 of this invention as used in a spindle assembly station of a two-for-one twister textile thread processing machine. However, it is to be understood that the bobbin holder 10 of this invention could be utilized with other types of textile machines for which bobbin holders are desired.

The spindle assembly station of the two-for-one twister textile thread processing machine includes a spindle assembly, generally indicated at 12, having a stationary carrier mechanism 14 for receiving hollow supply bobbins B of thread T. The spindle assembly 12 further includes a rotor mechanism 15 which is mounted to the machine frame 16 and constructed for rotation relative to the stationary carrier mechanism 14. The carrier mechanism 14 includes a hollow thread entry tube 17 extending axially through the thread bobbins B and providing a passageway for the thread therethrough. The thread passageway of the yarn entry tube 17 communicates with a thread passageway (not shown) in the rotor mechanism 15 for providing an elongate passageway extending axially through the thread bobbin B and radially outwardly beneath the base of the bobbin B. The carrier mechanism 14 includes a basket device 18 surrounding the thread bobbins B and a balloon limitor device 19 surrounding the basket device 18. The rotor mechanism 15 is rotatable driven by a drive belt 20 which is held in selective engagement therewith by a roll 21 in a known manner.

When the thread T is threaded through the spindle assembly 12 in the manner illustrated and the rotor mechanism 15 is rotated, the thread T is drawn from the bobbin or bobbins B and passes downwardly into the yarn entry tube 17 and through the yarn passageways to emerge from the rotor mechanism 15 to form a rotating balloon of thread T between the basket device 18 and the balloon limitor 19. The thread T is then directed through a thread guide eyelet 22 above the spindle assembly 12 and then to a takeup mechanism 24 including a pretakeup roll 25, a traversing mechanism 26 and a takeup package forming device 27 to form a takeup package P of processed thread T and which is rotated by drive roll 28.

This operation of a two-for-one twister textile thread processing machine is well understood by those with ordinary skill in the art and further explanation and illustration thereof is not deemed necessary herein for an understanding of the present invention.

In accordance with this invention, a bobbin holder 10 is provided for holding one or more bobbins B of varying heights in superimposed positions and adapted for being loosely and removably inserted into the bobbin carrier 14 of the two-for-one twister textile thread processing machine, as shown in FIGS. 1 and 2. The bobbin holder 10 includes an elongate tubular body 30 for receiving one or more of the hollow bobbins B of thread T on the outside thereof along the axial length thereof. Means are provided for varying the length of the tubular body 30 for accommodating bobbins B of varying heights. A radially-outwardly projecting support 31 is carried on the lower end of the tubular body 30 for supporting the bobbin or bobbins B of thread T on the tubular body 30. Preferably, the elongate body 30 comprises two tubular portions 30*a*, 30*b* connected together at respective ends thereof by the length varying means.

Figure 3:
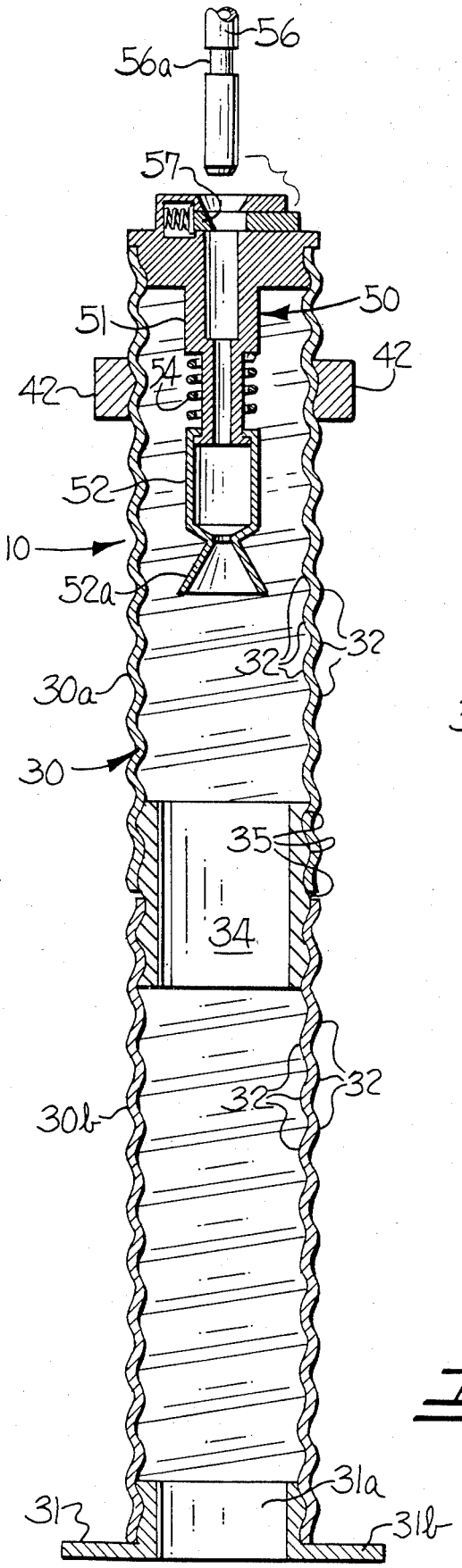
FIG. 3 is an axial sectional view through a first embodiment of bobbin holder in accordance with this invention.
Figure 4:
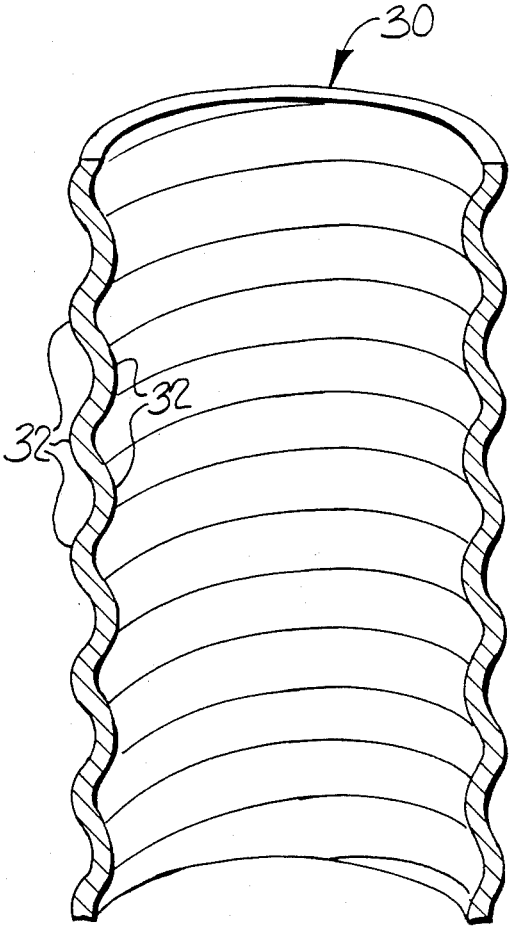
FIG. 4 is an enlarged sectional detail of a part of one of the tubular portions utilized in the bobbin holder of FIG. 3.

In a first preferred form of bobbin holder 10 in accordance with this invention as illustrated in FIGS. 3 and 4, the tubular portions 30*a*, 30*b* of the elongate body 30 include threads 32 and the length varying means comprises an elongate sleeve 34 having cooperating threads 35 for receiving the threads 32 on the tubular portions 30*a*, 30*b* of the elongate body 30. It is preferred to have these threads 32 on the tubular body portions 30*a*, 30*b* of the elongate body 30 as internal threads and the threads 35 on the sleeve member 34 as external threads so that the sleeve member 34 may be positioned inside the tubular portions 30*a*, 30*b* of the elongate body 30, as shown in FIG. 3. The tubular portions 30*a*, 30*b* may preferably have corrugated walls defining shallow round threads 32 on the inside and outside surfaces thereof and such tubular portions 30*a*, 30*b* may be extruded plastic members. The support 31 includes a sleeve member 31*a* having shallow round threads on the outside surface thereof for being received within the lower portion of the elongate body 30 and cooperating with the internal threads 32 for removably securing the support 31 to the elongate body 30. The support 31 further includes a radially-projecting collar 31*b* for supporting the bobbin or bobbins B of thread T.

Figure 5:
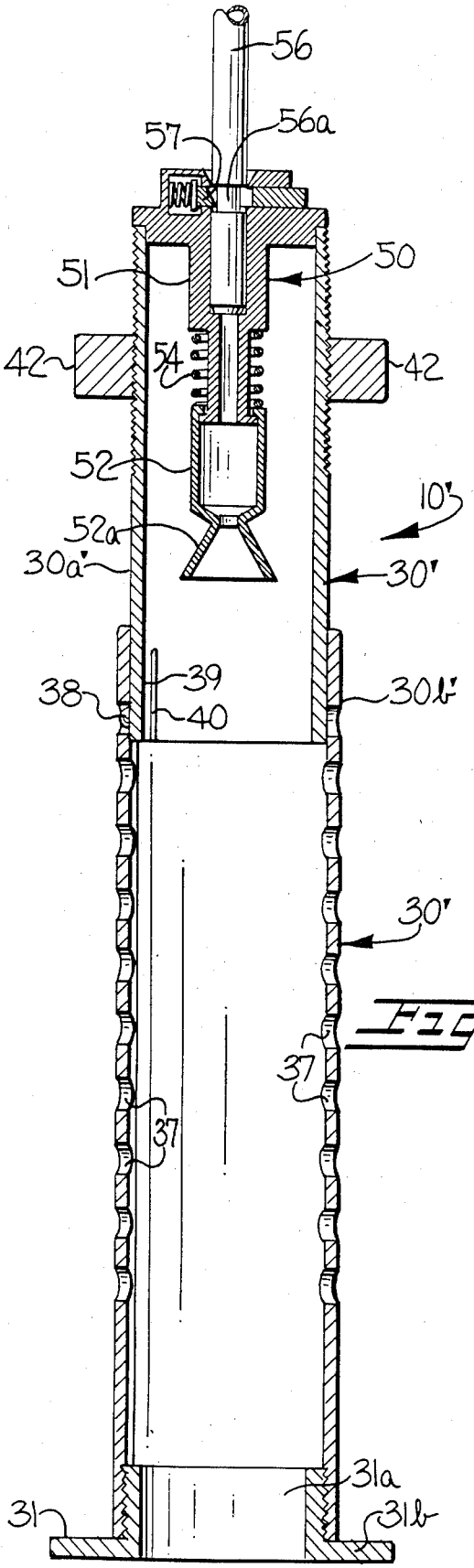
FIG. 5 is an axial sectional view, like FIG. 3, through a second embodiment of bobbin holder in accordance with this invention.
Figure 6:
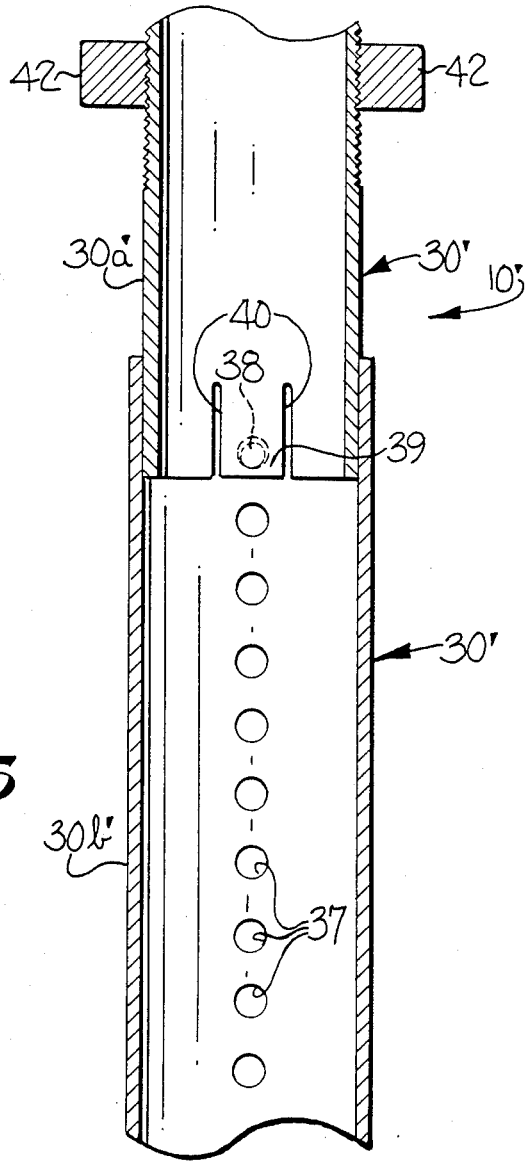
FIG. 6 is a sectional view of a portion of the bobbin holder of FIG. 5 and offset 90° with respect thereto for illustrating means for locking the telescoping portions of the bobbin holder in various positions.

In a second preferred embodiment of the bobbin holder 10′ as illustrated in FIGS. 5 and 6 wherein like reference numerals have been used for like components, the elongate body 30′ comprises movable telescoping portions 30*a*′, 30*b*′ and the means for varying the length of the elongate body 30′ comprises cooperating means on the telescoping portions 30*a*′, 30*b*′ for locking the telescoping portions 30*a*′, 30*b*′ in a plurality of telescoping positions. Such locking means may comprise a plurality of axially spaced apertures 37 along one of the telescoping portions 30*b*′ and a resilient detent member 38 on the other of the telescoping portions 30*a*′ for being received in a selected one of the apertures 37. This resilient detent member may comprise a hemispherical detent 38 carried on a resilient tongue 39 formed by a pair of slits 40 in the bottom of the telescoping portion 30*a*′. This embodiment of bobbin holder 10′ also includes a radially-outwardly projecting support 31 which includes telescoping sleeve member 31*a* for being received within the lower portion of the elongate body 30′, means removably securing the sleeve 31*a* to the elongate body 30′ in the form of threads on the outside surface of the sleeve 31*a* and threads on the inside surface of the elongate body 30′, and a radially-projecting collar 31*b* for supporting the bobbin or bobbins B of thread T on the elongate body 30′.

Either preferred embodiment of such bobbin holder may include at least one bobbin centering ring 42 on the outside of the elongate body 30, 30′ and means for adjustably positioning the bobbin centering ring 42 at desired axial positions along the elongate body 30, 30', such as threads on the inside surface of the centering ring 42 cooperating with external threads on the elongate body 30, 30'.

When either embodiment of bobbin holder 10, 10' is used in a two-for-one twister textile thread processing machine, the bobbin holder 10, 10' preferably includes a hollow head piece 50 removably secured within the upper part of the elongate body 30, 30', such as by external threads on the head piece 50 cooperating with internal threads on the elongate body 30, 30'. This hollow head piece cooperates with the thread entry tube 17 of the spindle assembly 12 to provide an entry passageway for the thread T from the bobbin or bobbins B carried by the bobbin holder 10, 10' into the spindle assembly 12. This head piece 50 comprises a stationary tubular member 51 extending downwardly from the top of the bobbin holder 10, 10', a movable tubular member 52 telescopingly positioned on the lower end of the stationary member 51 and having a generally downwardly-diverging funnel-shaped lower end portion **52*a* for being positioned over the top of the thread entry tube 17 of the spindle assembly 12, and spring means 54 operatively associated with the stationary member 51 and the movable member 52 for biasing the movable member 52 downwardly while allowing upward movement of the movable member 52 against the bias of spring means 54 for positioning the funnel-shaped end portion 52*a* over the top of the thread entry tube 17 of the spindle assembly 12**.

The bobbin holder 10, 10' may further include a thread insert tube 56 having a lower end portion removably positioned within the upper part of the head piece 50 for providing an additional thread entry passageway and a manually graspable handle for the bobbin holder 10, 10', as shown in FIGS. 1 and 2. A detent mechanism is provided for removably securing this thread insert tube 56 in the head piece 50 of the bobbin holder 10, 10' and may be in the form of a spring biased pawl 57 carried in the upper end of the stationary member 51 of the head piece 50 and a cutout portion **56*a* in the thread insert tube 56 as shown in FIGS. 3 and 5**.

Thus, an improved bobbin holder has been provided by this invention which is simple in construction and easy to manufacture for holding one or more bobbins of thread of varying heights in superimposed positions and adapted for being loosely and removably inserted into a bobbin carrier of a textile machine and which bobbin holder has provisions therein for varying the length thereof for accommodating bobbins of varying heights, as well as ancillary features described above.

In the drawings and specification there have been set forth preferred embodiments of this invention, and although specific terms are employed, they are used in a generic and descriptive sense only and not for purposes of limitation, the scope of the invention being defined in the following claims.

What is claimed is:

1. A bobbin holder for holding one or more bobbins of thread of varying heights in superimposed positions and adapted for being loosely and removably inserted into a bobbin carrier of a textile machine; said bobbin holder comprising:

an elongate tubular body for receiving one or more hollow bobbins of thread on the outside thereof along the axial length thereof and comprising two tubular portions;

means for connecting said two tubular portions of said elongate body and for varying the length of said elongate body to desired lengths between maximum and minimum lengths for accommodating bobbins of varying heights; and a radially-outwardly-projecting support carried on the lower end of said tubular body for supporting the bobbin or bobbins of thread on said tubular body.

2. A bobbin holder, as set forth in claim 1, in which said tubular portions of said elongate body include thread means thereon, and said length varying means comprises an elongate sleeve member having cooperating thread means thereon for receiving said thread means of said tubular portions of said elongate body.

3. A bobbin holder, as set forth in claim 2, in which said thread means on said tubular portions of said elongate body comprise internal threads, in which said thread means on said sleeve member comprise external threads, and in which said sleeve member is positioned inside said tubular portions of said elongate body.

4. A bobbin holder, as set forth in claim 2 or 3, in which said tubular portions of said elongate body have corrugated walls defining shallow round threads on the inside and outside surfaces thereof.

5. A bobbin holder, as set forth in claim 4, in which said tubular portions of said elongate body comprise extruded plastic members.

6. A bobbin holder, as set forth in claim 1, in which said tubular portions of said elongate body comprise movable telescoping portions.

7. A bobbin holder, as set forth in claim 6, in which said means for varying the length of elongate body comprises cooperating means on said telescoping portions for locking said telescoping portions in a plurality of telescoping positions.

8. A bobbin holder, as set forth in claim 7, in which said locking means comprises a plurality of axially-spaced apertures along one of said telescoping portions and a resilient detent member on the other of said telescoping portions for being received in a selected one of said apertures.

9. A bobbin holder for holding one or more bobbins of thread of varying heights and adapted for being loosely and removably inserted into a bobbin carrier of a textile thread processing machine; said bobbin holder comprising:

an elongate tubular body for receiving one or more hollow bobbins of thread on the outside thereof along the axial length thereof and comprising two tubular portions having corrugated walls defining shallow round threads on the inside and outside thereof;

an elongate sleeve member positioned inside said tubular portions of said elongate body and having cooperating external thread means along the length thereof to receive said thread means on the inside of said tubular portions of said elongate body for connecting said tubular portions together and for varying the length of said tubular body to desired lengths between maximum and minimum lenghts to accommodate bobbins of varying heights; and a radially-outwardly projecting support having an axially-extending sleeve portion including thread means thereon for being received by thread means on the lower end of said tubular body to be carried by said tubular body and for supporting the bobbin or bobbins of thread on said body.

10. A bobbin holder for holding one or more bobbins of thread of varying heights in superimposed positions and adapted for being loosely and removably inserted into a bobbin carrier of a textile machine; said bobbin holder comprising:

an elongate tubular body for receiving one or more hollow bobbins of thread on the outside thereof along the axial length thereof and comprising two movable telescoping tubular portions;

means for varying the length of said elongate body to desired lengths between maximum and minimum lengths for accommodating bobbins of varying heights comprising a plurality of axially spaced apertures along one of said telescoping portions and a resilient detent member on the other of said telescoping portions for being received in a selective one of said apertures; and a bobbin supporting member carried by the lower end of said elongate body and including a telescoping sleeve member for being received within the lower portion of the elongate body, means removably securing said sleeve to said elongate body, and a radially-projecting collar secured to said sleeve and projecting outwardly from said elongate body for supporting the bobbin or bobbins of thread on said elongate body.

11. A bobbin holder, as set forth in claim 1, 9 or 10, further including at least one bobbin centering ring on the outside of said elongate body and including means for adjustably positioning said bobbin centering ring at desired axial positions along said elongate body.

12. A two-for-one twister textile thread processing machine comprising:

a bobbin holder as set forth in claim 1, 9 or 10; and a spindle assembly for processing thread received from the bobbin or bobbins held by said bobbin holder and including a bobbin carrier mechanism for loosely and removably receiving therein said bobbin holder.

13. A two-for-one twister textile thread processing machine, as set forth in claim 12, in which said spindle assembly includes a hollow thread entry tube for being positioned within said bobbin holder and for receiving thread from the bobbin or bobbins for processing in said spindle assembly, and in which said bobbin holder includes a hollow head piece removably secured within the upper part of said elongate body for cooperating with said thread entry tube of said spindle assembly to provide an entry passageway for the thread from the bobbin or bobbins carried by said bobbin holder into said spindle assembly.

14. A two-for-one twister textile thread processing machine, as set forth in claim 13, in which said head piece comprises a stationary tubular member extending downwardly from the top of said bobbin holder, a movable tubular member telescopingly positioned on the lower portion of said stationary member and having a generally downwardly-diverging funnel-shaped lower end portion for being positioned over the top of said thread entry tube of said spindle assembly, and spring means operatively associated with said stationary member and said movable member for biasing said movable member downwardly while allowing upward movement of said movable member against the bias for positioning said funnel-shaped end portion over the top of said thread entry tube of said spindle assembly.

15. A two-for-one twister textile thread processing machine, as set forth in claim 14, in which said bobbin holder further includes a thread insert tube having a lower end portion removably positioned within the upper part of said head piece for providing an additional thread entry passageway and a manually graspable handle for said bobbin holder.

16. A two-for-one twister textile thread processing machine, as set forth in claim 15, in which said bobbin holder further includes a detent mechanism for removably securing said thread insert tube in said head piece.

* * * * *